US008197091B1

(12) United States Patent
Kyle et al.

(10) Patent No.: US 8,197,091 B1
(45) Date of Patent: Jun. 12, 2012

(54) LED UNIT FOR INSTALLATION IN A POST-TOP LUMINAIRE

(75) Inventors: Sturgis D. Kyle, York, PA (US); Justin M. Walker, Littestown, PA (US); Neil Ruberg, New Oxford, PA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 446 days.

(21) Appl. No.: 12/467,075

(22) Filed: May 15, 2009

(51) Int. Cl.
*F21V 21/00* (2006.01)

(52) U.S. Cl. ..... 362/249.06; 362/294; 362/431

(58) Field of Classification Search ..... 362/153, 362/153.1, 249.02, 249.06, 249.14, 294, 362/431
See application file for complete search history.

(56) References Cited

U.S. PATENT DOCUMENTS

| | | | |
|---|---|---|---|
| 4,081,023 | A | 3/1978 | Edelstein |
| 4,321,656 | A | 3/1982 | Gruver |
| 4,503,360 | A | 3/1985 | Bedel |
| 4,509,106 | A | 4/1985 | Mayer |
| 4,729,076 | A | 3/1988 | Masami |
| 4,734,835 | A | 3/1988 | Vines |
| 4,871,944 | A | 10/1989 | Skwirut |
| 4,954,822 | A | 9/1990 | Borenstein |
| 5,010,452 | A | 4/1991 | Krebser |
| 5,136,287 | A | 8/1992 | Borenstein |
| 5,138,541 | A | 8/1992 | Kano |
| 5,351,172 | A | 9/1994 | Attree |
| 5,537,301 | A | 7/1996 | Martich |
| 5,548,499 | A | 8/1996 | Zadeh |
| 5,688,042 | A | 11/1997 | Madadi |
| 5,785,418 | A | 7/1998 | Hochstein |
| 5,980,071 | A | 11/1999 | Hsieh |
| 5,993,027 | A | 11/1999 | Yamamoto |
| 6,068,384 | A | 5/2000 | Tyson |
| 6,154,362 | A | 11/2000 | Takahashi |
| 6,183,114 | B1 | 2/2001 | Cook |
| 6,193,603 | B1 | 2/2001 | Tai |
| 6,350,043 | B1 | 2/2002 | Gloisten |
| 6,350,046 | B1 | 2/2002 | Lau |
| 6,367,949 | B1 | 4/2002 | Pederson |
| 6,379,024 | B1 | 4/2002 | Kogure |
| 6,402,346 | B1 | 6/2002 | Liao |
| 6,502,962 | B1 | 1/2003 | Menke |
| 6,573,536 | B1 | 6/2003 | Dry |
| 6,632,006 | B1 | 10/2003 | Rippel |
| 6,678,168 | B2 | 1/2004 | Kenny |
| 6,705,751 | B1 | 3/2004 | Liu |
| 6,815,724 | B2 | 11/2004 | Dry |
| 6,860,628 | B2 | 3/2005 | Robertson |
| 6,871,983 | B2 | 3/2005 | Jacob |
| 6,905,227 | B2 | 6/2005 | Wu |

(Continued)

FOREIGN PATENT DOCUMENTS

| | | | |
|---|---|---|---|
| JP | 2006172895 | A1 | 6/2006 |

(Continued)

*Primary Examiner* — Y My Quach Lee
(74) *Attorney, Agent, or Firm* — John F. Salazar; Mark L. Beloborodov

(57) ABSTRACT

An LED unit is provided with a plurality of LED panels each having a support surface supporting at least one LED. The LED unit may be provided with a frame that may support the LED panels and the arrangement of the LED panels may be movable between a symmetric and an asymmetric configuration.

14 Claims, 7 Drawing Sheets

U.S. PATENT DOCUMENTS

| | | | | |
|---|---|---|---|---|
| 6,955,440 | B2 | 10/2005 | Niskanen | |
| 6,974,233 | B1 | 12/2005 | Aubrey | |
| 6,994,452 | B2 | 2/2006 | Rozenberg | |
| 6,997,583 | B2 | 2/2006 | Broelemann | |
| 7,014,341 | B2 | 3/2006 | King | |
| 7,098,486 | B2 | 8/2006 | Chen | |
| 7,118,261 | B2 * | 10/2006 | Fredericks et al. | 362/249.14 |
| 7,140,753 | B2 | 11/2006 | Wang | |
| 7,307,546 | B1 | 12/2007 | Partap | |
| 7,311,423 | B2 | 12/2007 | Frecska | |
| 7,329,031 | B2 | 2/2008 | Liaw | |
| 7,440,280 | B2 | 10/2008 | Shuy | |
| 7,524,089 | B2 | 4/2009 | Park | |
| 7,641,361 | B2 * | 1/2010 | Wedell et al. | 362/249.02 |
| 7,677,761 | B2 * | 3/2010 | Chiang | 362/249.02 |
| 2002/0122309 | A1 | 9/2002 | Abdelhafez | |
| 2004/0120152 | A1 | 6/2004 | Bolta | |
| 2004/0141326 | A1 | 7/2004 | Dry | |
| 2005/0030761 | A1 | 2/2005 | Burgess | |
| 2005/0036322 | A1 | 2/2005 | Veffer | |
| 2005/0122229 | A1 | 6/2005 | Stevenson | |
| 2005/0168986 | A1 | 8/2005 | Wegner | |
| 2005/0190567 | A1 | 9/2005 | Childers | |
| 2005/0207168 | A1 | 9/2005 | Chabert | |
| 2005/0276053 | A1 | 12/2005 | Nortrup | |
| 2006/0109661 | A1 | 5/2006 | Coushaine | |
| 2006/0164843 | A1 | 7/2006 | Adachi | |
| 2006/0193139 | A1 | 8/2006 | Sun | |
| 2006/0209545 | A1 | 9/2006 | Yu | |
| 2006/0215408 | A1 | 9/2006 | Lee | |
| 2006/0262545 | A1 | 11/2006 | Piepgras | |
| 2007/0030686 | A1 | 2/2007 | Haugaard | |
| 2007/0097678 | A1 * | 5/2007 | Yang | 362/249 |
| 2007/0211470 | A1 | 9/2007 | Huang | |
| 2007/0230172 | A1 | 10/2007 | Wang | |
| 2007/0230183 | A1 | 10/2007 | Shuy | |
| 2007/0230184 | A1 | 10/2007 | Shuy | |
| 2007/0247853 | A1 | 10/2007 | Dorogi | |
| 2007/0253208 | A1 * | 11/2007 | Howard et al. | 362/431 |
| 2007/0279909 | A1 | 12/2007 | Li | |
| 2008/0007955 | A1 | 1/2008 | Li | |
| 2008/0043472 | A1 | 2/2008 | Wang | |
| 2008/0080188 | A1 | 4/2008 | Wang | |
| 2008/0084701 | A1 | 4/2008 | Van De Ven | |
| 2008/0158887 | A1 | 7/2008 | Zhu | |
| 2008/0165535 | A1 | 7/2008 | Mazzochette | |
| 2008/0205062 | A1 | 8/2008 | Dahm | |
| 2008/0212333 | A1 | 9/2008 | Chen | |
| 2008/0304269 | A1 | 12/2008 | Pickard | |
| 2009/0080189 | A1 | 3/2009 | Wegner | |
| 2009/0086476 | A1 | 4/2009 | Tickner | |
| 2009/0086481 | A1 | 4/2009 | Wegner | |

FOREIGN PATENT DOCUMENTS

| | | | |
|---|---|---|---|
| JP | 2008171584 | A1 | 7/2008 |

* cited by examiner

LED UNIT FOR INSTALLATION IN A POST-TOP LUMINAIRE

CROSS-REFERENCE TO RELATED DOCUMENTS

Not Applicable.

TECHNICAL FIELD

This invention pertains to a LED unit for installation in a post top luminaire.

BACKGROUND

Outdoor post-top luminaires typically include a base, such as a post or other support, which supports a fitter. The fitter supports a globe that encloses a light source such as an incandescent or HID bulb. The globe may be designed with refractive surfaces, prismatic surfaces and the like to help achieve a desired light distribution from the post-top luminaire. Furthermore, a reflective shield may be included within the globe to redirect some light from the light source and help achieve a desired light distribution pattern.

BRIEF DESCRIPTION OF THE ILLUSTRATIONS

Embodiments of the invention are illustrated in the following Figures.

DETAILED DESCRIPTION

Figure 1:
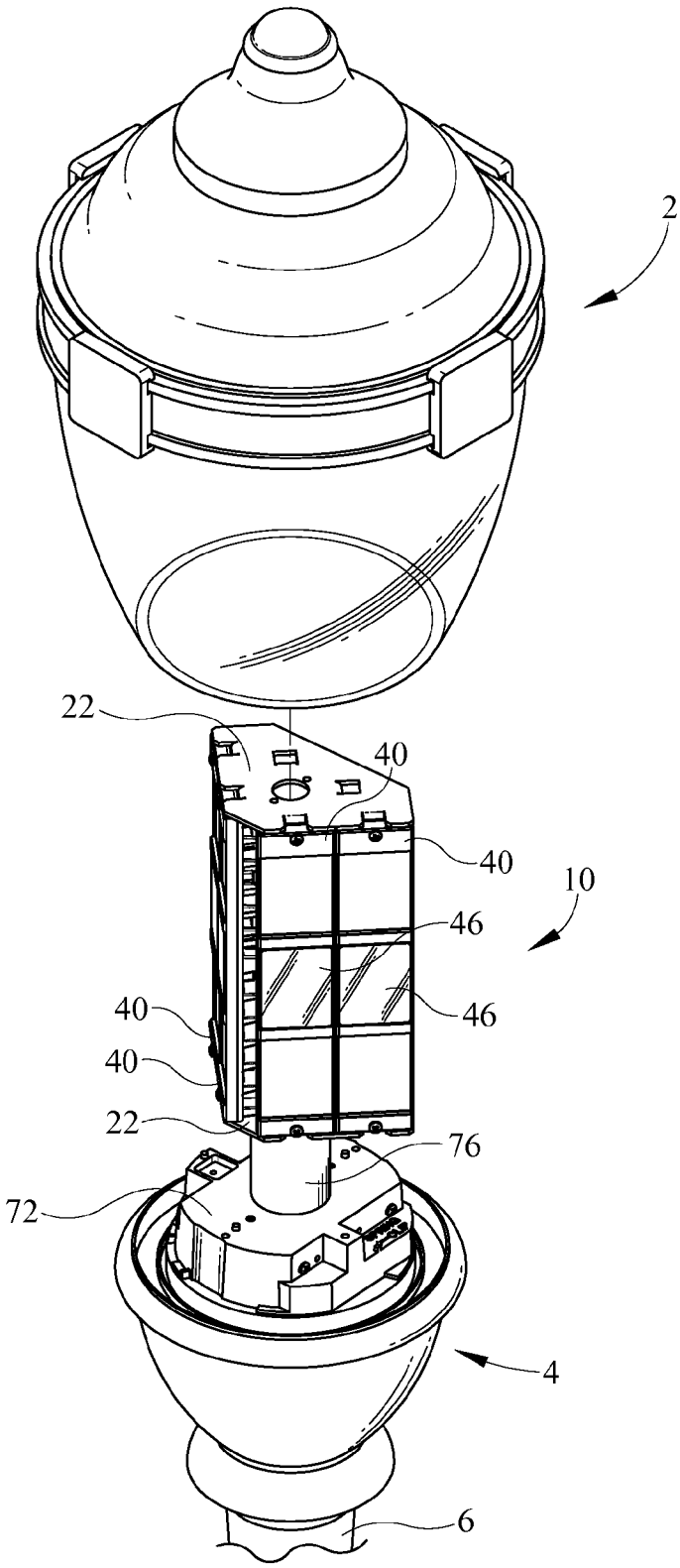
FIG. 1 is a top perspective view showing a first embodiment of a LED unit installed in a post-top luminaire, with a globe of the post-top luminaire exploded away, and LED panels installed in an asymmetric configuration.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now to the Figures, wherein like numerals refer to like parts, and in particular to FIG. 1 through FIG. 5 where an embodiment of an LED unit 10 is shown. In FIG. 1 LED unit 10 is shown installed in a post-top luminaire. The post-top luminaire includes a support base or pole 6 which is coupled to and supports a fitter 4. The fitter 4 supports a globe 2, shown in FIG. 1 exploded away from fitter 4. The globe 2 may be sealably retained by fitter 4, forming an optical chamber substantially sealed from the external environment. Globe 2 may be designed to help achieve a given light distribution pattern and may be provided with a refractive surface, prismatic surface, and/or reflectors, among other items, if desired for a particular light distribution. The post-top luminaire of FIG. 1 is provided for exemplary purposes and as made apparent from the present description, LED unit 10 may be used with or adapted for use with a variety of post-top luminaires having varied support, fitter, and/or globe configurations, among other things. For example, globe 2 may include a separable roof portion. The roof portion may be removably sealed to the globe and the globe may be removably or fixedly sealed to the fitter 4.

Figure 2:
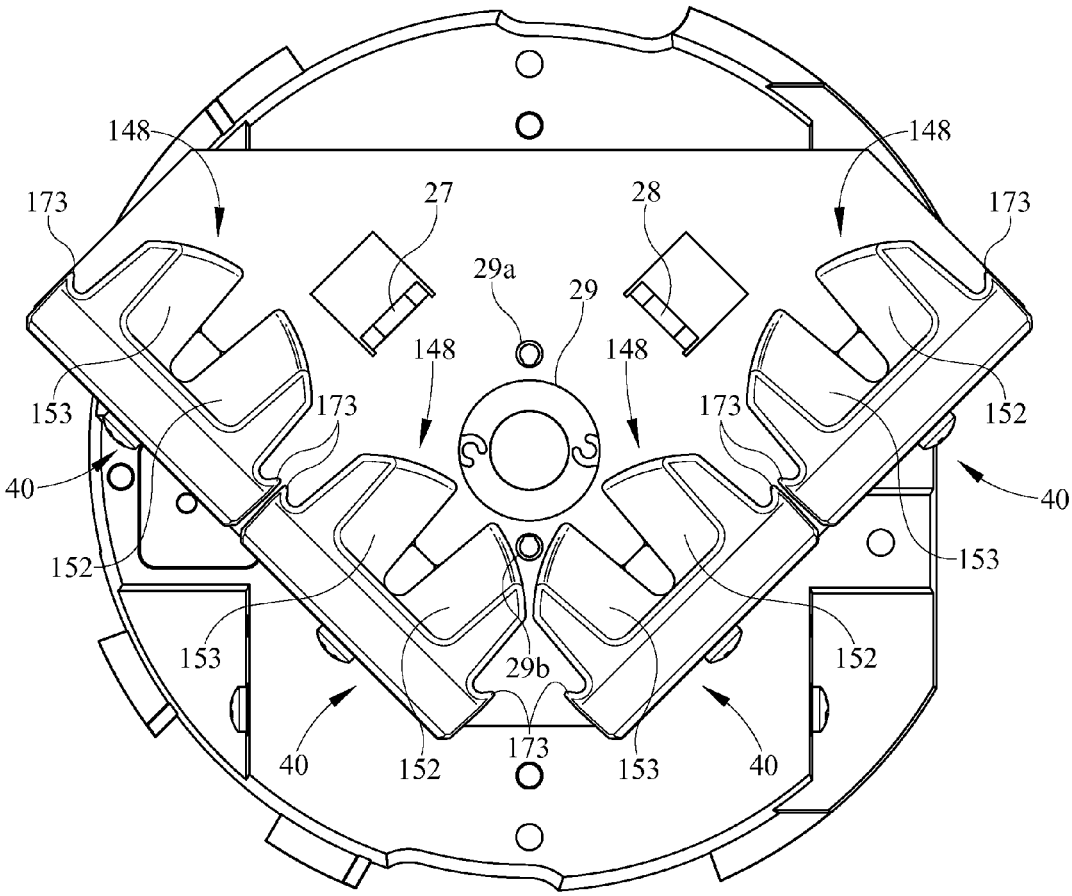
FIG. 2 is a top view of the LED unit of FIG. 1 with a top symmetric and asymmetric frame removed and the LED panels installed in an asymmetric configuration.
Figure 4:
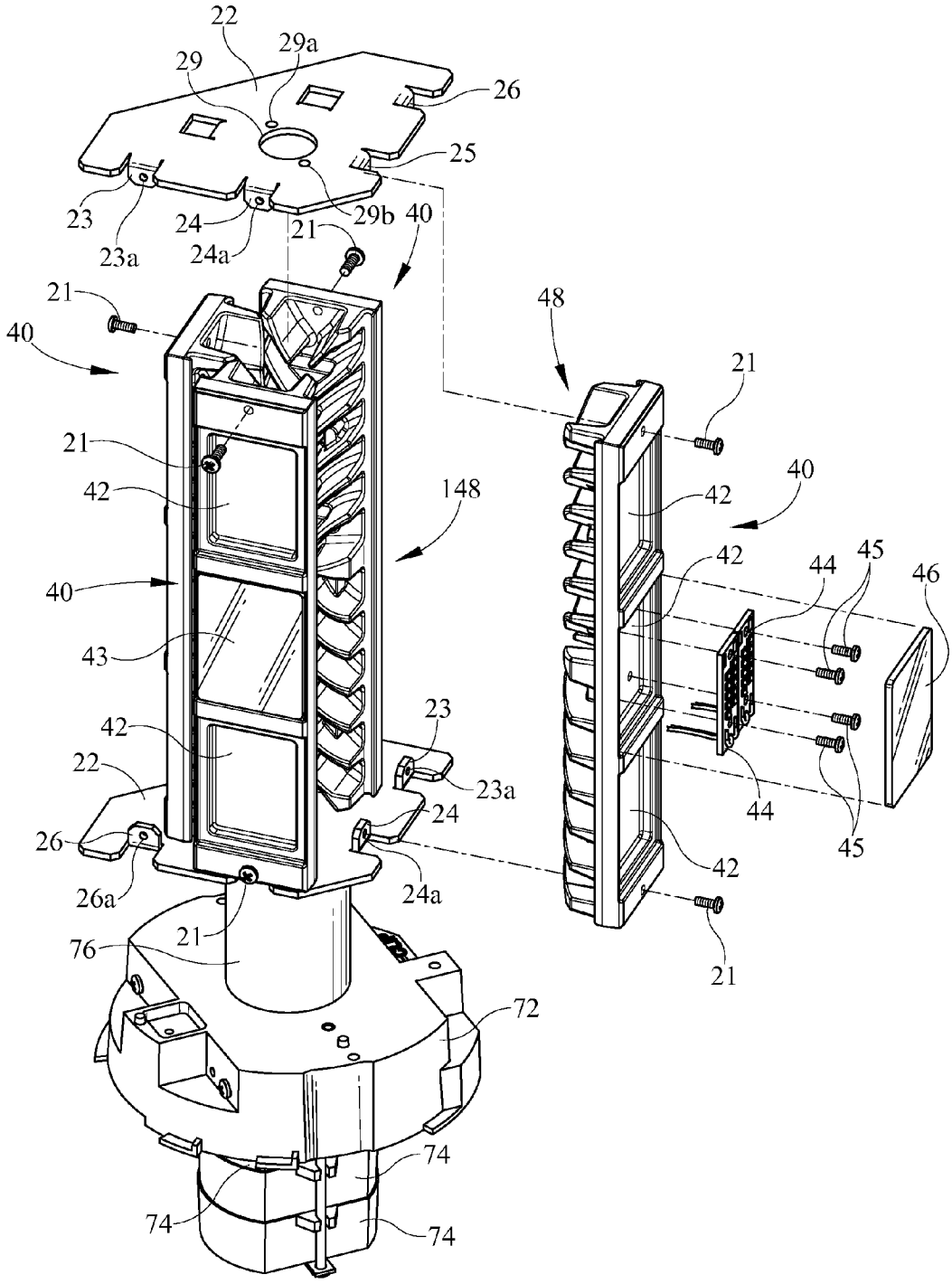
FIG. 4 is a perspective view of the LED unit of FIG. 1 showing LED panels installed in a symmetric configuration and one symmetric and asymmetric frame exploded away and one LED panel exploded away.
Figure 5:
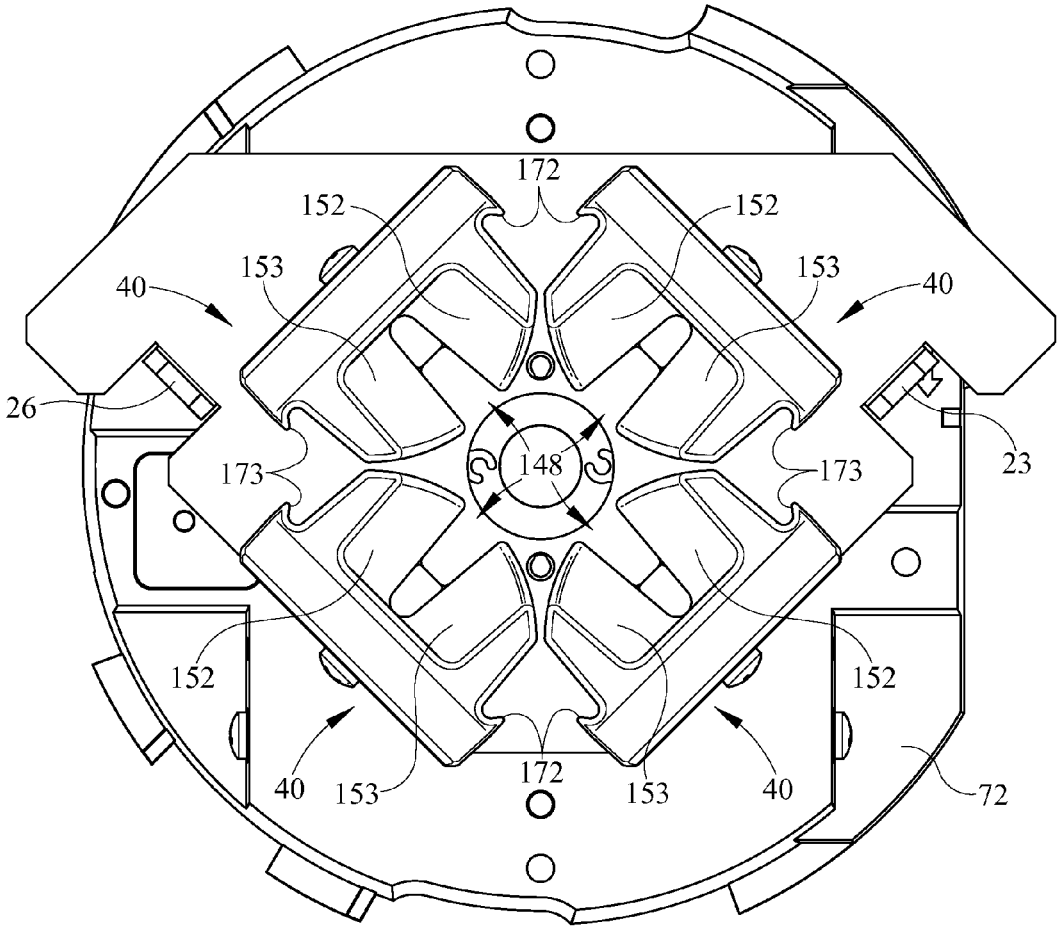
FIG. 5 is a top view of the LED unit of FIG. 1 with a top symmetric and asymmetric frame removed and the LED panels installed in a symmetric configuration.

LED unit 10 has an LED driver cover 72 that may be removably affixed to the fitter 4 and that may cover at least one LED driver 74. In FIG. 1 and FIG. 2, four vertically oriented elongated LED panels 40 are depicted disposed above the LED driver cover 72 in a generally V-shaped arrangement coupled to a pair of symmetric and asymmetric frames 22. The generally V-shaped arrangement of LED panels 40 in FIG. 1 and FIG. 2 provides for asymmetric light distribution from LED unit 10. The particular asymmetric distribution depicted provides for asymmetric distribution wherein a substantial majority of light output from LED unit 10 is directed within a range of one-hundred and eighty degrees to provide directional lighting from the LED unit 10 and reduce any backlighting. In FIG. 4 and FIG. 5, four LED panels 140 are depicted in a generally square shaped arrangement coupled to the symmetric and asymmetric frames 22. The generally square shaped arrangement of the LED panels 140 in FIG. 4 and FIG. 5 provides for symmetric light distribution from LED unit 10.

Each LED panel 40 in FIG. 1 and FIG. 2 is provided with a lens 46 that covers a single centrally aligned recessed pocket having a printed circuit board with at least one LED attached thereto. In alternative configurations the recessed pocket may be non-centrally aligned. Each LED panel 40 shown in FIG. 4 and FIG. 5 has a support surface with three recessed pockets 42. With particular reference to FIG. 4, at least one LED printed circuit board, such as LED printed circuit boards 44, may be received in each recessed pocket 42 and secured in recessed pocket by, for example, screws 45. In some embodiments LED printed circuit boards 44 may be a metal core circuit board and have seven or ten one-watt Luxeon Rebel LEDs coupled thereto. In alternative configurations differing numbers of LEDs may be used as well as printed circuit boards of differing material. A thermal interface material may optionally be interposed between LED printed circuit board 44 and the support surface of the LED panel 40. In some embodiments the thermal interface material may include a thermal pad such as an eGRAF HITHERM HT-1220 thermal pad manufactured GrafTech. In alternative configurations other thermal interface materials may optionally be used such as, but not limited to, thermal grease or thermal paste. A lens 46 may then be placed over LED printed circuit boards 44 and seal each recessed pocket 42 in such a manner as to achieve appropriate ingress protection rating qualifications if desired. In some embodiments each lens 46 may be affixed using a high temperature silicone and achieve an ingress protection rating of IP 66. In some embodiments the high temperature silicone may be Dow Corning 733 Glass and Metal Sealant. One or more apertures may also be provided through portions of LED panel 40 to enable wiring to extend from one or more LED drivers 74 to any LED printed circuit board 44. Such apertures may likewise be sealed with high temperature silicone to achieve appropriate ingress rating qualifications.

As depicted in FIG. 4, less than all of recessed pockets 42 may be provided with a LED printed circuit board. This allows for a manufacturer and/or user to use the same LED panel 40 with a variable amount of LED printed circuit boards 44 in order to provide flexibility in luminous output and/or light distribution from LED unit 10. For example, as shown in FIG. 4, only one recessed site 42 may be provided with a LED printed circuit board 44 and covered with a lens 46. Alternatively, each recessed site 42 may be provided with a LED printed circuit board and covered with a lens 46, providing for a higher luminosity LED unit 10. In other embodiments of LED unit 10, a support surface for LEDs may be provided without recessed sites 42 or with a greater or lesser number of recessed sites 42, and/or with larger or smaller recessed sites 42 that may accommodate variable sized or variable numbers of printed circuit boards. For example, as shown in FIG. 1, only a single centrally located recessed site may be provided and covered with a lens 46 and the area on either side of the recessed site may be non-recessed.

Extending rearward from each support surface of each LED panel 40 is a heatsink 148 having a plurality of curved heat fins that extend rearward and away from the support surface of each LED panel 40. In the depicted embodiments LED support surface and LED heatsink 148 are formed as an integral piece, which can be made, for example, by a casting from aluminum or an aluminum alloy such as a 356 Hadco Modified aluminum alloy. Heatsink 148 is in thermal connectivity with recessed sites 42 and any LED printed circuit boards 44 received by recessed sites 42 and helps dissipate heat generated by any LED printed circuit board 44.

Figure 3:
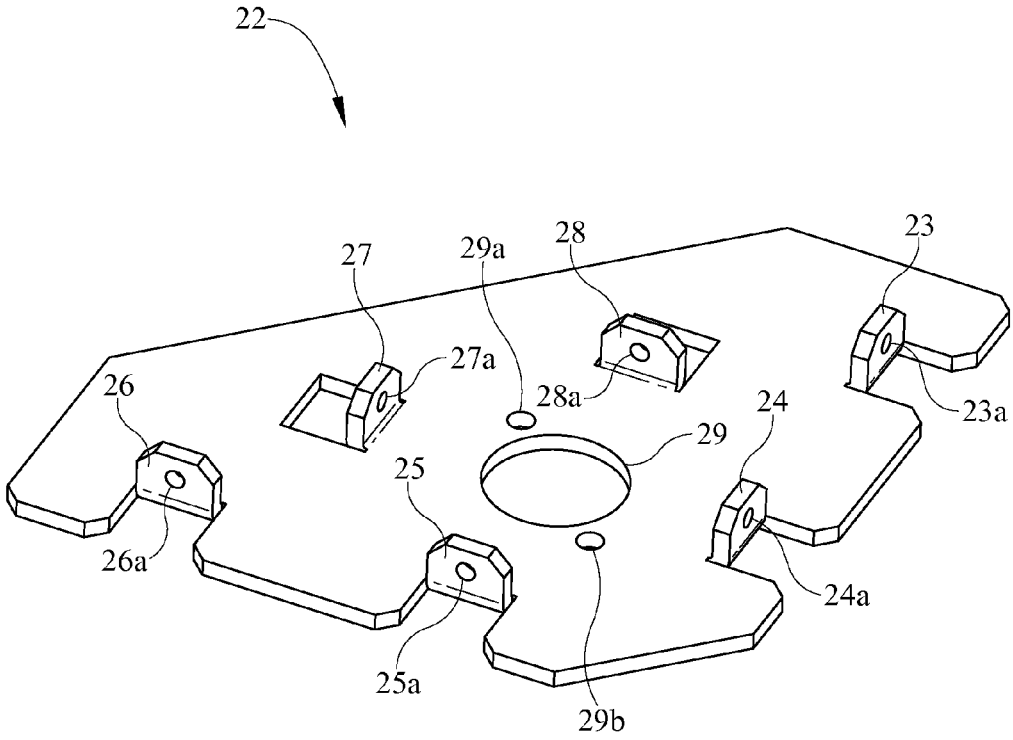
FIG. 3 is a top perspective view of one symmetric and asymmetric frame of the LED unit of FIG. 1.

With particular reference to FIG. 3, one embodiment of the symmetric and asymmetric frame 22 is described in more detail. The frame 22 has six tabs 23, 24, 25, 26, 27, and 28. The tabs 23, 24, 25, 26, 27, and 28 are arranged generally in the shape of an isosceles right angle triangle, with tabs 23 and 24 arranged along a first leg, tabs 25 and 26 arranged along a second leg, and tabs 27 and 28 arranged along a hypotenuse. Each tab 23, 24, 25, 26, 27, and 28 has a corresponding receptacle 23*a*, 24*a*, 25*a*, 26*a*, 27*a*, and 28*a* therethrough. An opening 29 extends through the frame 22 and has two securing apertures 29*a* and 29*b* on either side for attachment of the frame 22 to a support base 76. The depicted frame 22 is formed from a single piece of sheet metal and the tabs, receptacles, and apertures cut and formed from the single piece of sheet metal.

In the asymmetric LED panel arrangement of FIG. 1 and FIG. 2 two of the LED panels 40 have common orientations that are offset approximately ninety degrees from the other two LED panels 40 that also have common orientations. In the symmetric LED panel arrangement of FIG. 4 and FIG. 5, each of the LED panels 40 has a unique orientation that is offset approximately ninety degrees from two other LED panels 40 and is offset approximately one-hundred and eighty degrees from one other LED panel 40. In the asymmetric arrangement, LED panels 40 are connected to tabs 23, 24, 25, and 26. In the symmetric arrangement the LED panels 40 are coupled to tabs 24, 25, 27, and 28. To change from a symmetric to an asymmetric configuration in this embodiment of frames 22 involves uncoupling two LED panels 40 from tabs 23 and 26 and coupling the two uncoupled LED panels 40 to tabs 27 and 28.

Each LED panel 40 is held in place by screws 21 that are inserted through apertures in a front face of each LED panel 40 and received in one of the receptacles 23*a*, 24*a*, 25*a*, 26*a*, 27*a*, or 28*a* of symmetric and asymmetric frames 22. The screws 21 associated with any one LED panel 40 may be loosened to allow for movement of each LED panel 40 to another location on symmetric and asymmetric frame 22 or to remove each LED panel 40 from LED unit 10 if desired. One or more LED panels 40 may be removed to alter the distribution pattern and/or luminous intensity of LED unit 10 and may be removed by a user or prior to packaging. The ability to selectively detach and reattach each LED panel to desired connection areas on frames 22 provides an easily customizable LED unit 10 providing for flexibility in light distribution and luminosity. While a screw 21 extending through a corresponding aperture of each LED panel 40 and received in one of the receptacles 23*a*-28*a* has been described, one skilled in the art will recognize that other fasteners and other mechanical affixation methods may be used in some embodiments to removably attach each LED panel 40 to a given location on the frame 22. For example, prongs, fasteners, latches and/or structure extending from one or more frames 22 may interface with corresponding structure on LED panels 40. Also, this interchangeably includes prongs, fasteners, latches, and/or structure extending from LED panels 40 that correspond with structure on one or more frames 22. Also, although one embodiment of LED unit 10 has been described as having both a top and a bottom frame 22 with specific structure, one skilled in the art will recognize that other frame configurations, including singular frame configurations, may properly support LED panels 40. Also, although a specific symmetric and asymmetric arrangement of LED panels 40 have been described, one skilled in the art will recognize that other symmetric and asymmetric arrangements may be used as desired for particular light distributions and outputs.

Each LED panel 40 may be individually adjusted to a given orientation on symmetric and asymmetric frames 22 at the factory or by a user, allowing for symmetric and asymmetric distribution patterns from LED unit 10 that may be selectively adjusted as desired. Reflective shields may be used, but are not needed with LED unit 10, as LED panels 40 may be oriented on frames 22 to direct light away from a given area in order to achieve asymmetric light distribution. LED unit 10 may be used in retrofit applications if desired and LED panels 40 may be configured in a symmetric or asymmetric distribution pattern to replicate a previously existing distribution pattern, or create a new distribution pattern, while interfacing with the same preexisting globe of the post-top luminaire. In some embodiments LED unit 10 may be used to replace an incandescent light source or a metal halide light source.

A support base 76 may support the bottom frame 22 and is coupled to LED driver cover 72, which covers three LED drivers 74. In other embodiments only one LED driver, two LED drivers, or more than three LED drivers may be provided. Frame support base 76 may be interchanged at the factory or by a user with a frame support base of a differing height to permit vertical adjustment of the LED panels 40 in order to appropriately position LED unit 10 within a globe of a particular post-top luminaire. The depicted LED driver cover 72 is a Twistlock ballast cover manufactured by Hadco from die cast aluminum and is designed to rotatably engage corresponding structure extending from the top of a fitter of a post-top luminaire and be locked in place with a spring clip. The depicted LED driver cover 72 and LED unit 10 provide for tool-less installation of LED unit 10. However, as understood in the art, other driver covers may be utilized to appropriately isolate LED drivers, such as LED drivers 74. LED drivers 74 may be placed in electrical communication with one another and contain a terminal block or other connection for electrically coupling LED drivers 74 with power from a power source. In some embodiments LED drivers 74 may be one or more drivers manufactured by Magtech, part number LP1025-36-00700. In some embodiments LED drivers 74 may be one or more drivers manufactured by OSRAM, part number OT25-120-277-700E.

Figure 6:
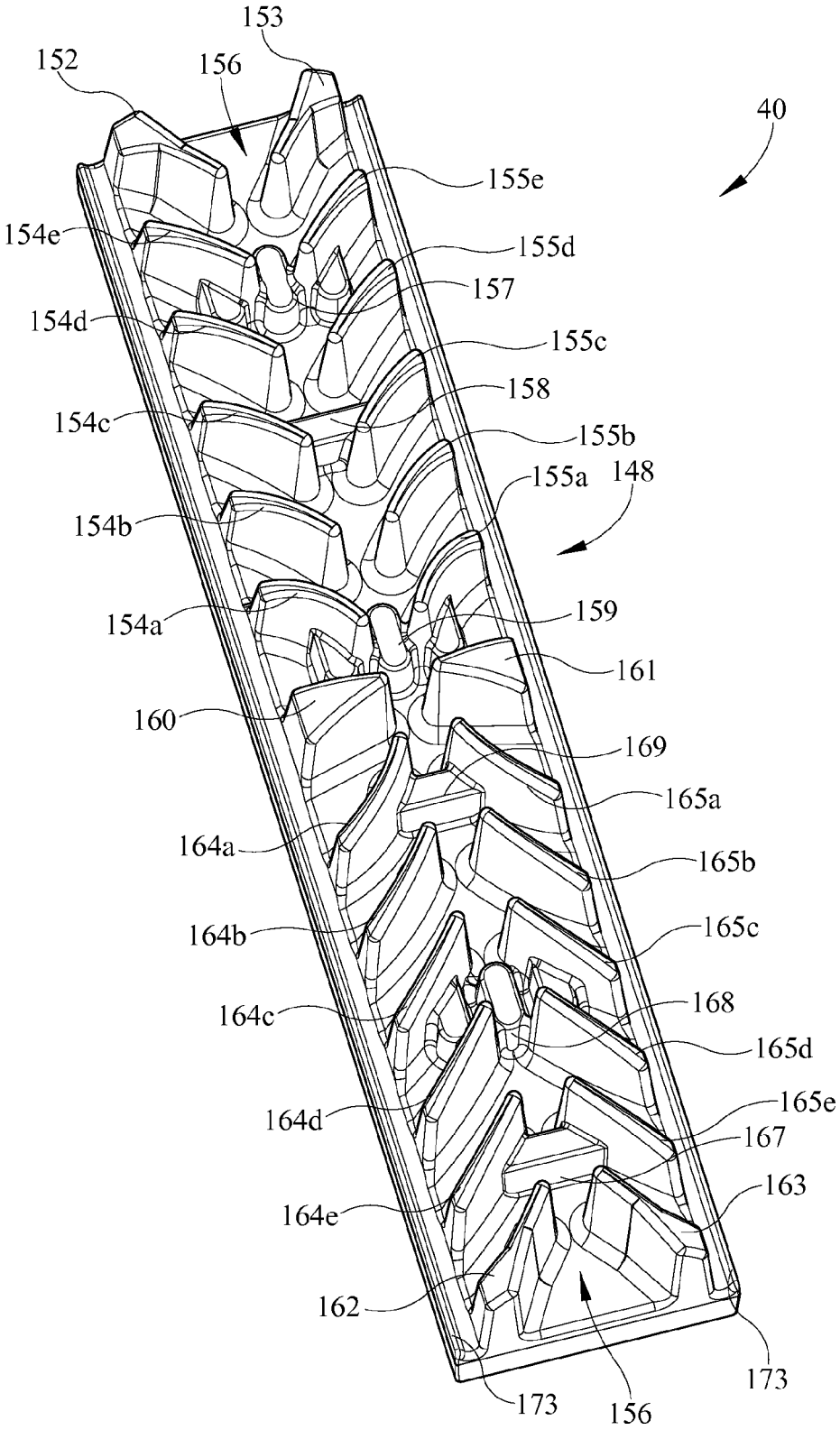
FIG. 6 is a perspective view of a heatsink of the LED panel of the LED unit of FIG. 1.
Figure 7:
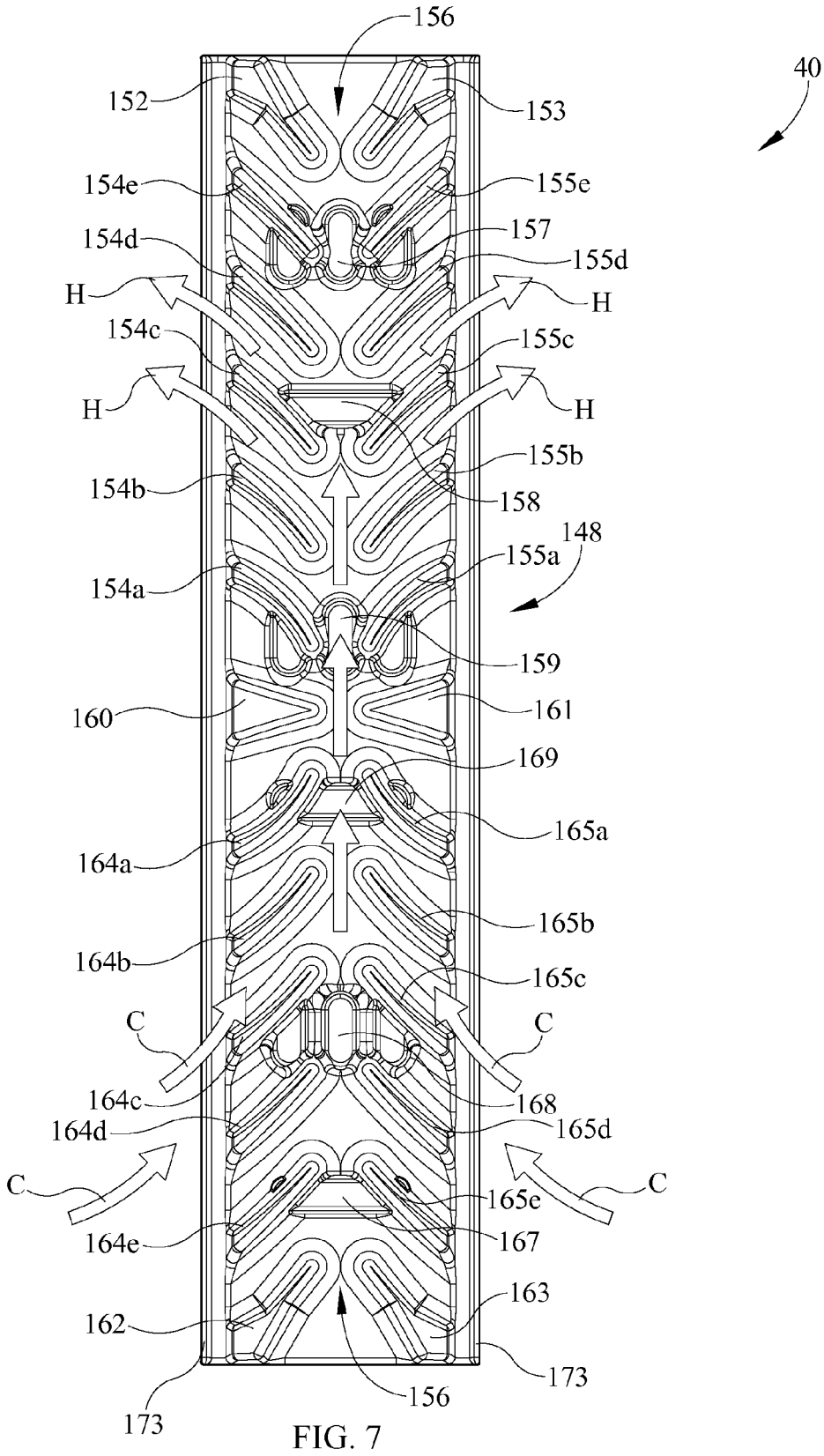
FIG. 7 is a top view of the heatsink of FIG. 6.

Referring now to FIG. 6 and FIG. 7, the depicted embodiment of heatsink 148 is described in more detail. Heatsink 148 has a plurality of arcuate heat fins 154*a-e*, 155*a-e*, 164*a-e*, and 165*a-e* flanking each side of a channel 156 that extends longitudinally along the entire length of heatsink 148. In some embodiments LED heatsink 148 may be sand casted from an aluminum alloy such as a 356 Hadco Modified aluminum alloy. In the depicted embodiment channel 156 is centrally aligned and includes bosses 157, 158, 159, 167, 168, and 169 that extend partially into channel 156. Bosses 157, 158, 159, 167, 168, and 169 may receive corresponding screws or other fasteners that are used to secure printed circuit boards within recessed sites 142. Fasteners that are used to secure printed circuit boards within recessed sites 142 may also or alternatively be received in bosses that are completely or partially contained within any or all of arcuate heat fins 154*a-e*, 155*a-e*, 164*a-e*, and 165*a-e*.

The arcuate heat fins 154*a-e*, 155*a-e*, 164*a-e*, and 165*a-e* extend from proximal central channel 156 toward the longitudinal periphery of heatsink 148 and are oriented to efficiently dissipate heat from heatsink 148 when heatsink 148 is oriented vertically, horizontally, or at an angle between horizontal and vertical. Each arcuate heat fin 154*a-e*, 155*a-e*, 164*a-e*, and 165*a-e* has a first end located proximal central channel 156 and a second end located proximal a trough adjacent a ridge 173 that extends longitudinally proximal the longitudinal periphery of the heatsink 148.

Heatsink 148 may be divided latitudinally into a first portion and a second portion in some embodiments. In the depicted embodiment pie shaped heat fins 160 and 161 divide heatsink 148 into a first and second portion and define a latitudinal dividing region. Each arcuate heat fin 154*a-e*, 155*a-e*, 164*a-e*, and 165*a-e* is oriented such that the interior face of each arcuate heat fin 154*a-e*, 155*a-e*, 164*a-e*, and 165*a-e* generally faces toward the dividing region generally defined by pie shaped heat fins 160 and 161 and generally faces away from channel 156. Also, the second end of each arcuate heat fin 154*a-e*, 155*a-e*, 164*a-e*, and 165*a-e* is more distal the dividing region and channel 156 than the first end of each arcuate heat fin and the exterior face of each arcuate heat fin generally faces toward channel 156. As a result of the shape and orientation of the heat fins, the amount of heat that becomes trapped in between the heat fins and reabsorbed is reduced.

When oriented in a non-horizontal direction, heat dissipation is further optimized by heatsink 148 as a result of natural convection. For example, assuming heat fins 152 and 153 are located at a higher vertical position than heat fins 162 and 163, hot air, exemplarily designated by Arrows H in FIG. 7, is forced outward and away from heatsink 148. Cooling air, exemplarily designated by Arrows C in FIG. 7, is drawn toward the heatsink from the surrounding environment. Central channel 156 provides a path for communication of air between heat fins, exemplarily designated by the unlabeled arrows extending through central channel 156, and further aids in heat removal and natural convection. The shape and orientation of the heat fins in the depicted embodiment aids natural convection by forcing heat outward and away from heatsink 148 while drawing in cooling air and reduces reabsorption of heat by the heat fins of heatsink 148. The shape of the heat fins also provides additional surface area for improved convection. In some embodiments an apparatus such as a fan may be used in conjunction with heatsink 148 for forced convection.

In the depicted embodiment of heatsink 148 each arcuate heat fin 154*a-e*, 155*a-e*, 164*a-e*, and 165*a-e* is a curved segment of a circle and has a corresponding arcuate heat fin that also forms a curved segment of the same circle. Also, in the depicted embodiment each arcuate heat fin 154*a-e*, 155*a-e*, 164*a-e*, and 165*a-e* has a mirror imaged heat fin located on the opposite side of channel 156 that also has a corresponding arcuate heat fin that also forms a segment of the same circle. For example, arcuate heat fins 155*a* and 165*a* form a segment of the same circle and may generally circulate air between one another, potentially increasing the convective current. Opposite arcuate heat fins 155*a* and 165*a* are arcuate heat fins 154*a* and 164*a*, which form a segment of a circle that is the same radius of the segment of the circle formed by arcuate heat fins 155*a* and 165*a*. Also, arcuate heat fins 155*e* and 165*e* form a segment of the same circle, which is much larger than the circle partially formed by arcuate heat fins 155*a* and 165*a*. In other words, arcuate heat fins 155*e* and 165*e* have a more gradual curvature than arcuate heat fins 155*a* and 165*a*.

In the depicted embodiment of heatsink 148, the curvature of heat fins 154*a-e*, 155*a-e*, 164*a-e*, and 165*a-e* becomes more gradual the farther away from pie shaped heat fins 160 and 161 it is located, such that each heat fin progressively forms a segment of a larger circle. Heat fins 152, 153, 162, and 163 are not segments of a circle, but do aid in the convective process and help dissipate heat away from, and draw cooling air into, heatsink 148. Also, although the interior facing portion of arcuate heat fins 152, 153, 162, and 163 is formed from two nearly linear portions, it still has a generally arcuate overall shape. Extending along the longitudinal peripheries of heatsink 148 is a ridge portion 173, which sits atop a trough and may be provided for additional surface area for dissipation of heat.

Although heatsink 148 has been illustrated and described in detail, it should not be limited to the precise forms disclosed and obviously many modifications and variations to heatsink 148 are possible in light of the teachings herein. For example, in some embodiments some or all arcuate heat fins may not form a segment of a circle, but may instead be otherwise arcuate. Also, for example, in some embodiments some or all arcuate heat fins may not be provided with a corresponding mirror imaged heat fin on an opposite side of a channel and/or an opposite side of a dividing region. Also, for example, in some embodiments where a dividing region is present, the dividing region may not have any heat fins such as pie shaped heat fins 160 and 161. Also, for example, in some embodiments heat fins may have one or more faces formed from multiple linear segments and still be generally arcuate in shape. Although heatsink 148 has been described in conjunction with a LED unit 10, one skilled in the art will readily recognize its uses are not limited to such. Also, one skilled in the art will recognize that alternative embodiments of LED unit 10 may utilize alternative heatsinks, such as heatsinks with a plurality of linear and parallel fins, or may be provided without a heatsink if desired.

The foregoing description has been presented for purposes of illustration. It is not intended to be exhaustive or to limit the invention to the precise forms disclosed, and obviously many modifications and variations are possible in light of the above teaching. It is understood that while certain forms of the invention have been illustrated and described, it is not limited thereto except insofar as such limitations are included in the following claims and allowable functional equivalents thereof.

We claim:

1. An LED unit for installation in a post top luminaire having a globe, the LED unit comprising:

a frame having six connection areas arranged in a generally triangular shape, four of said six connection areas forming two legs of said generally triangular shape with two of said six connection areas on each of said legs and the remaining two of said six connection areas forming a hypotenuse of said generally triangular shape;

an LED driver;

four LED panels, each of said LED panels coupled to said frame at a single of said six connection areas and having a support surface supporting at least one LED electrically connected to said LED driver, wherein at least two of said LED panels are individually removable from said frame and wherein support surface of each of said LED panels has at least one recessed pocket receiving at least one LED printed circuit board.

2. The LED unit of claim 1, wherein said generally triangular shape is a generally right angle isosceles triangular shape.

3. An LED unit for installation in a post top luminaire having a globe, the LED unit comprising:

a frame having six connection areas arranged in a generally triangular shape, four of said six connection areas forming two legs of said generally triangular shape with two of said six connection areas on each of said legs and the remaining two of said six connection areas forming a hypotenuse of said generally triangular shape;

an LED driver;

four LED panels, each of said LED panels coupled to said frame at a single of said six connection areas and having a support surface supporting at least one LED electrically connected to said LED driver, wherein at least two of said LED panels are individually removable from said frame, and wherein each said connection area includes a tab with an aperture therethrough.

4. The LED unit of claim 3, wherein each of said LED panels is coupled to one of said connection areas by a fastener extending through an aperture in said LED panel and received in said aperture of said tab of one of said connection areas.

5. The LED unit of claim 4, wherein said generally triangular shape is a generally right angle isosceles triangular shape.

6. An LED unit for installation in a post top luminaire, comprising:

a pair of frames vertically spaced apart from one another, at least one of said frames coupled to the post top luminaire;

a plurality of vertically oriented LED panels capable of collectively producing a light output, each of said LED panels removably coupled to said frames at a fixed orientation, each of said LED panels having a support surface with at least one LED printed circuit board affixed thereto;

wherein each of said LED panels is individually detachable and removable from said frames; and wherein said LED panels may be coupled to said frames in either a symmetric configuration capable of producing a substantially symmetric said light output or an asymmetric configuration capable of producing a substantially asymmetric said light output.

7. The LED unit of claim 6, wherein each said support surface of each said LED panel has at least one recessed pocket receiving said at least one LED printed circuit board.

8. The LED unit of claim 7, wherein each said recessed pocket is sealed by a lens.

9. The LED unit of claim 6, wherein in said asymmetric configuration at least ninety percent of said light output is aimed within a range of one hundred and eighty degrees.

10. The LED unit of claim 6, wherein in said symmetric configuration at least four LED panels are provided and arranged in a generally square configuration.

11. The LED unit of claim 6, wherein in said asymmetric configuration said plurality of LED panels are arranged in a generally V shaped configuration.

12. The LED unit of claim 11, wherein in said asymmetric configuration said support surfaces of at least two of said plurality of LED panels are perpendicular to one another.

13. The LED unit of claim 10, wherein each of said LED panels is coupled to each said frame by a fastener extending through said LED panel and received in a corresponding receptacle of each said frame.

14. The LED unit of claim 9, wherein each of said LED panels has a heatsink extending rearward and away from said support surface, said heatsink having a plurality of arcuate heat fins.

* * * * *